United States Patent [19]

Kawai et al.

[11] 4,037,127

[45] July 19, 1977

[54] X-RAY TUBE

[75] Inventors: Shinichi Kawai, Yokohama; Shigeo Maeyama, Fujisawa; Tokihiko Shidara, Yokohama, all of Japan

[73] Assignee: Tokyo Shibaura Electric Co., Ltd., Kawasaki, Japan

[21] Appl. No.: 746,061

[22] Filed: Nov. 30, 1976

[30] Foreign Application Priority Data

Dec. 5, 1975 Japan ..... 50-164294[U]

[51] Int. Cl.[2] ..... H01J 35/04

[52] U.S. Cl. ..... 313/60; 313/55; 313/330

[58] Field of Search ..... 313/60, 55, 330

[56] References Cited

U.S. PATENT DOCUMENTS 2,345,723 4/1944 Atlee et al. ..... 313/60

*Primary Examiner*—Rudolph V. Rolinec
*Assistant Examiner*—Darwin R. Hostetter
*Attorney, Agent, or Firm*—Cushman, Darby & Cushman

[57] ABSTRACT

An X-ray tube comprises an anode including a target giving off X-rays when electrons emitted from the filament of the cathode impinge upon the target and being heated at this time, and a supporting structure for supporting the target and being subject to transfer of the heat produced on the target, the anode being plated with black chromium the black chromium plating is not applied onto the electron striking surface of the target. The thickness of the chromium plating is 0.05 to 0.2 μm, preferably 0.05 to 0.1 μm. The roughness of the plated surface is 0.5 to 20 μm, preferably 5 to 20 μm. In the rotating anode X-ray tube, for example, the black chromium plating, in place of the conventional blacking treatment by copper sulfide, is applied onto the outer surface of the rotor. In this case, the radiation efficiency for the heat rays with the wavelength of about 4 μm is obtained approximately three times as large as that of the conventional one.

8 Claims, 6 Drawing Figures

X-RAY TUBE

BACKGROUND OF THE INVENTION

This invention relates to an X-ray tube, and more particularly to an X-ray tube with an anode to which the blackening treatment is applied.

In the X-ray tube, X-rays are produced by impingement of electrons emitted from the filament of the focusing electrode of the cathode onto the target of the annode. In this case, approximately 99% of the kinetic energy of the electrons is transformed into heat with the resultant of temperature rise of the target. Thus, how to effectively dissipate the heat produced in the target is one of serious problems in the X-ray tube, and the X-ray output capacity depends largely on the heat dissipation.

From a structural view point, the X-ray tube is classified into two; a stationary anode X-ray tube and a rotating anode X-ray tube. In the case of the stationary anode X-ray tube, the anode is relatively easily cooled with a peculiar construction that the anode including a chip-shaped target is hermetically fixed at one end of an air-sealed envelope. In the rotating anode X-ray tube, a disc-shaped target of the anode rotates in the air-sealed envelope. As a result, a certain portion on the target is subject to the impingement of the electrons and then it dissipates to some degree the heat accumulated therein until it rotates to return to the position where it is again struck by electrons. However, it is in fact difficult to construct the structure sufficiently cooling the anode, since the target rotates at a high speed, e.g. 3000 to 12000 r.p.m. There is further a high possibility that the heat conducted from the target to the ball bearing for supporting the rotary shaft, deforms the ball bearing. For this, in the rotating anode X-ray tube, the anode is conventionally cooled through the heat radiation from the target, the rotary shaft and the rotor fixed or the rotary shaft.

Known is a rotating anode X-ray tube the outer surface of whose rotor is covered with a black layer of copper sulfide for the purpose of attaining an effective heat dissipation. The copper sulfide layer is bluish black and is insufficient in terms of radiation of the heat rays on the order of 4 μm wavelength, occupying the most part of the amount of heat rays produced in the X-ray tube. Therefore, the heat radiation characteristic of the above-mentioned X-ray tube is insufficient for a large capacity X-ray tube.

Thus, in the X-ray tube, more particularly in the rotating anode X-ray tube, there has earnestly been desired an advent of the X-ray tube having a high heat radiation characteristic permitting an effective anode cooling. Also, in the stationary anode X-ray tube, a high heat radiation characteristic of the anode is preferable because it advantageously assists the cooling.

SUMMARY OF THE INVENTION

Accordingly, the object of the present invention is to provide an X-ray tube having a high heat radiation characteristic of the anode.

In the present invention, the anode comprises a target producing X-rays in response to the impingement of electrons thereon and to be heated, and supporting means for supporting the target and to be heated by the heat conducted from the target. The target other than the electron striking surface thereof is covered with black chromium layer plated. In the rotating anode X-ray tube, target supporting means a rotary shaft fixed at one end to disc-like target and a rotor fixed to the rotary shaft for radiating the heat conducted from the target. In the stationary anode X-ray tube, target supporting means has a supporting rod hermetically fixed to one end of an air-sealed envelope and including a chip-like target buried in the one end of the rod which opposes the filament.

The black chromium plating may be performed by using the solution commercially available. The experiment showed that the heat radiation effeciently in the case of the blackening treatment of the anode by black chromium plating is in the vicinity of 4 μm wavelength of heat rays about three times that in the case of the blackening treatment of the anode by copper sulfide, although it depends upon the wavelength. The black chromium is preferably so plated as to have a predetermined thickness on the surface to be plated having a predetermined roughness.

Other objects, features and advantages of this invention will become apparent as the description thereof proceeds when considered in connection with the accompanying drawings.

DETAILED DESCRIPTION OF THE PREFERRED EMBODIMENTS

This invention will now be described concerning the case where the invention is applied to a rotating anode X-ray tube.

For the sake of clearness and brevity, the directions, relative positions and the like of the components are used in this specification only in connection with the view of the accompanying drawings, and the components so described, in actual practice, may have different directions, relative positions and the like.

Figure 1:
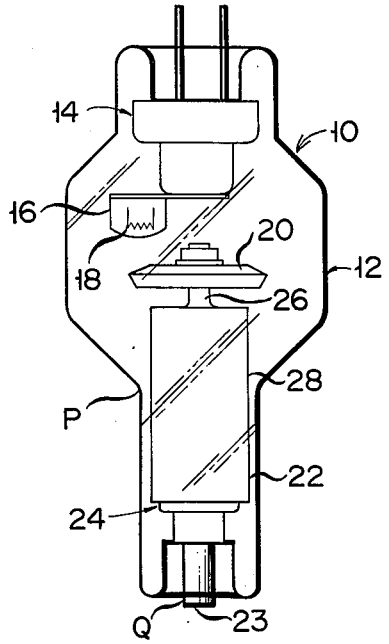
FIG. 1 shows a schematic elevation view of a conventional rotating anode X-ray tube.

As shown in FIG. 1, a rotating anode X-ray tube generally designated by reference numeral 10 compises an air-sealed envelope 12 made of the insulating material such as glass or ceramics, and a cathode 14 is fixed at the upper part thereof. The cathode 14 is provided at the bottom with a focusing electrode 16 eccentrically disposed with respect to the cathode 14. The focusing electrode 16 has a filament 18 emitting electrons when it is sufficiently heated. At the lower part of the envelope 12, an anode 24 is disposed in opposite to the cathode 14. The anode 24 includes a disc-like target 20 radiating X-rays in all directions in the surrounding space when electrons from the filament 18 impinge upon the target 20 and supporting means 22 rotatably supporting the target 20 and an anode terminal 23. The supporting means 22 has a rotary shaft 26 with the target 20 fixed to the top end thereof and being rotatable at a high speed by a rotating field developing device (not shown) disposed around the envelope 12 and a hollow cylindrical rotor 28 coaxially mounted to the shaft 26. The heat produced in the target 20 due to the electron hitting dissipates into the surrounding space in the form of the heat radiation partly from the target itself and partly from the rotary shaft 26 and the rotor 28 to which the heat is conducted. Since the heat radiation from the rotor 28 greatly affects the functions of the ball bearing, the rotor is made of good conductive material such as copper, copper alloy or the like, and has a large surface.

The black chromium plating is not applied onto the electron striking surface of the target 20, by reason that the electron striking surface is heated to an extremely high temperature and thus the plated layer is resolved, if it should be made on that surface.

The outer surface of the rotor 28 of the target supporting means 22 is chromium-plated to have a black metal layer deposited thereon. The black chromium plating onto the outer surface is performed in the following manner. The outer surface of the rotor 28 is first cleaned by pickling to ensure a firm adherence of the metal layer onto the outer surface. The plating follows the cleaning step. The solution for the chromium plating may be commercially available decorative solution consisting of chromium trioxide $CrO_3$ of 300 to 400 g/l, barium acetate $Ba(CH_3COO)_2$ of 5 to 10 g/l, and zinc acetate $Zn(CH_3COO)_2$ of 2 to 5 g/l. After plating, the rotor is rinsed for removing the solution and then dried.

Figure 2:
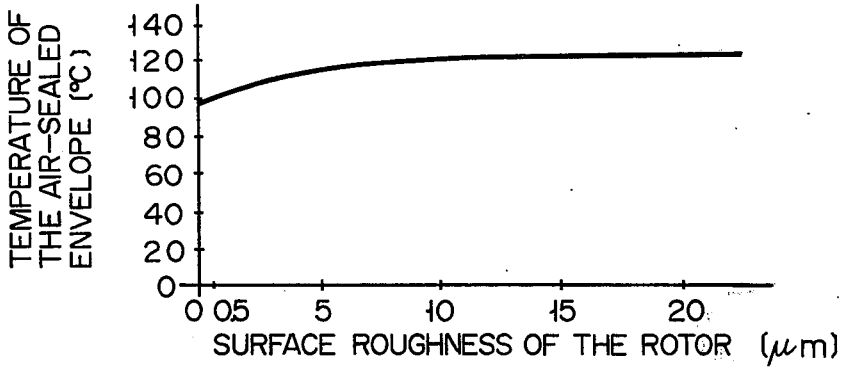
FIG. 2 shows a characteristic curve of the temperature of the air-sealed envelope vs. the surface roughness of the rotor when the thickness of the plating is 0.1 μm.
Figure 3:
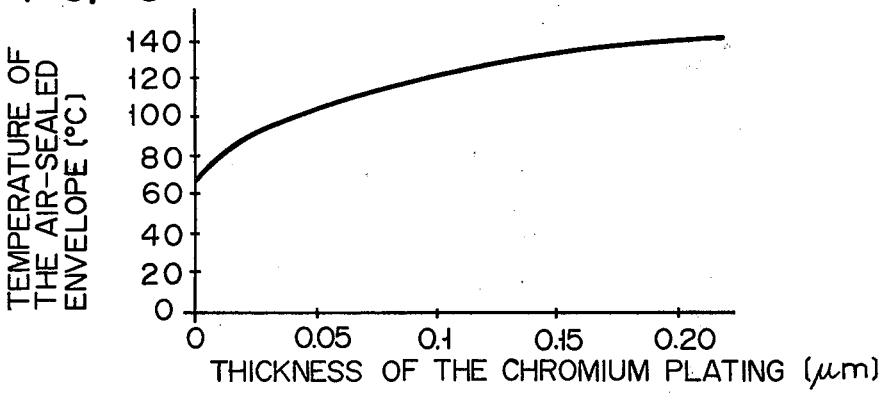
FIG. 3 shows a characteristic curve of the temperature of the air-sealed envelope vs. the thickness of the chromium plating when the surface roughness is 10 μm.

A highly smoothed surface of the article to be plated is undesirable because the adherence of the plated layer is weak and the layer is possibly peeled off the surface when it is heated. A much rough surface of the article for plating is also unpreferable, because the surface grinding of the article is not only troublesome but the breakdown voltage of X-ray tubes is reduced, although the adhering condition of the plated layer is little affected adversely. The surface roughness of the rotor versus the temperature of the air-sealed envelope, when the thickness of plated layer is 0.1 μm, is shown in FIG. 2. As seen from the figure, in the surface roughness ranging from 0.5 to 20 μm, particularly from 5 to 20 μm, the heat radiated sufficiently heats the air-sealed envelope 12 and, from this fact, a satisfactory heat radiation of the rotor is confirmed. It is preferable that the rotor surface to be plated is relatively rough. The reason for this is that such a degree of surface roughness enhances the adherence of the plated layer and provides an irregular reflection of the heat radiation. The surface roughness is expressed by the maximum roughness $H_{max}$. p With a presumption that there must be some effect of the thickness of the plated layer onto the heat radiation, the relation of the thickness of the plated layer to the temperature of the air-sealed envelope was investigated and the characteristic curve as shown in FIG. 3 was obtained. In this experiment, the surface roughness of the rotor was 10 μm. The characteristic curve of the figure shows that a heat is sufficiently radiated when the thickness of the plated layer ranges from 0.05 to 0.20 μm, particularly from 0.05 to 0.1 μm. In the case of more than 0.2 μm, a long timme is necessary for plating process and the layer is deposited unevenly to have projections and, in an extreme case, the layer is peeled off.

Figure 4:
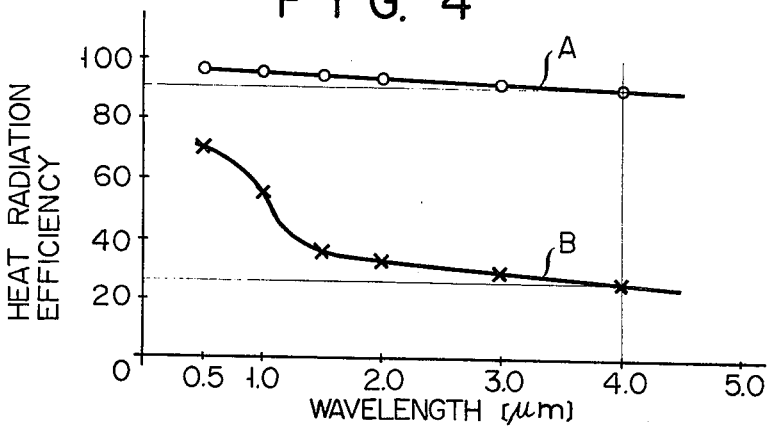
FIG. 4 shows the characteristic of the radiation efficiency of heat rays.
Figure 5:
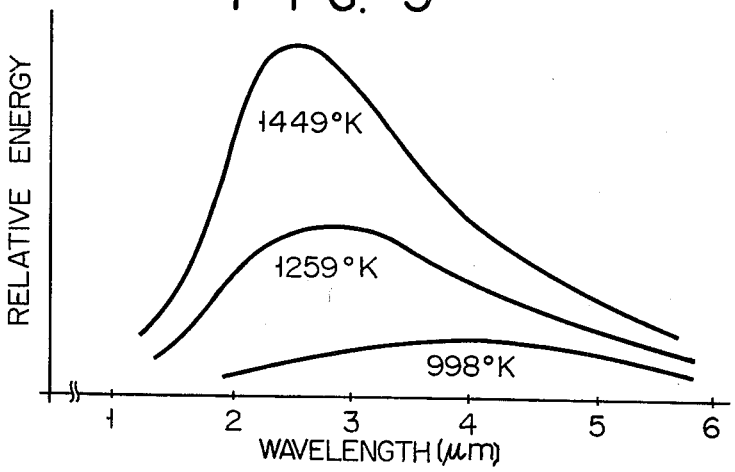
FIG. 5 shows the characteristic of the wavelength distribution of heat rays.

The heat radiation efficiency of the rotating anode X-ray tube whose rotor outer surface is coated with black chromium layer plated and that of the rotating anode X-ray tube whose rotor outer surface is plated with copper sulfide layer were measured with the thickness of each plating of 0.2 μm, and the result is shown in FIG. 4. In the figure, a curve A represents the heat radiation of the X-ray tube with the black chromium plating and a curve B that of the X-ray tube with copper sulfide plating. From the figure, it will be seen that the radiation of the heat rays having more than 1.0 μm in wavelength is two or three times as large as that of the conventional one. In the X-ray tube the wavelength distribution of the heat rays produced from the anode depends on the temperature of the anode, i.e. the rotor in this example. The relative energy to the respective temperatures of the rotor, 998° K, 1259° K and 1449° K is related as shown in FIG. 5. In an ordinary operation condition of the X-ray tube, the rotor of the X-ray tube is heated to have the temperature from 700° to 1000° K. From FIG. 5, it will be seen that, if the radiation efficiency of the heat rays in the vicinity of the wavelength 4 μm is improved, a satisfactory cooling of the X-ray tube may be obtained. Referring again to FIG. 4, the heat radiation efficiency of the chromium plating X-ray tube is more than three times that of the conventional one. This shows apparently that the present invention is effective.

Figure 6:
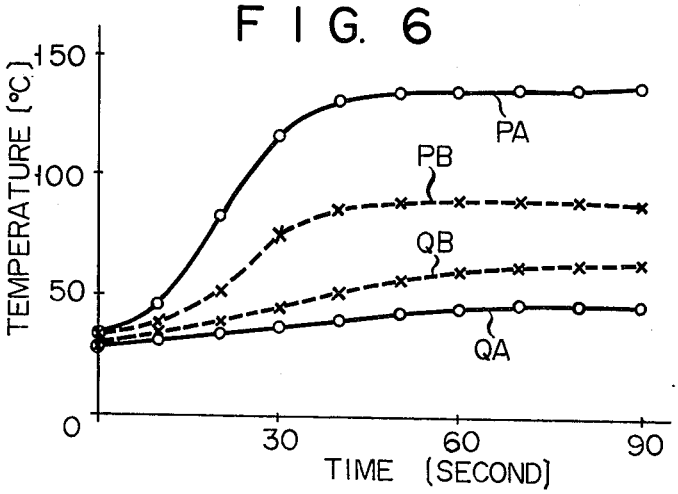
FIG. 6 shows the temperature variation of the air-sealed envelope.

In FIG. 6 are shown the measurement results of the temperature rise at the point P on the side wall of the air-sealed envelope on the level corresponding to the center portion of the rotor and at the point Q on the side wall of the anode terminal. This figure shows the heat radiation is improved by the present invention. In the figure, the curves PA and QA, respectively, represent temperature rises at the measuring points P and Q on the envelope side wall and the anode terminal of the X-ray tube with the rotor coated with black chromium layer deposited according to the present invention. The curves PB and QB, respectively, represent temperature rises at the corresponding measuring points in the case where the outer surface of the rotor is plated with copper sulfide layer. From FIG. 6, it will be seen that, in the case of the black chromium plating, the temperature on the side wall of the air-sealed envelope heated by the heat radiation from the rotor is high in comparison with the conventional one, while, on the anode terminal, the temperature is lower. This fact results from the improvement of the heat radiation efficiency by the black chromium plating. The experiments for plotting the curves in FIGS. 2, 3 and 6 were conducted in such a manner that the anode voltage was set at 40 kV, the anode current at 4 mA, the outer surface of the rotor was plated with black chromium deposited layer, and the rotor was not rotated. This is because it is very difficult to execute the experiments under an actual operating condition of the rotating anode X-ray tube. In actual operation, the rotating anode X-ray tube operates at higher voltage under oil cooling. This would represent that the temperature rise of the X-ray tube exhibits a tendency different from those of FIG. 6. It is to be noted, therefore, that the experiments conducted aim restrictively at comparing the present invention with the prior art except the various factors other than the black chromium treatment.

As described above, X-ray tube according to the present invention in which the outer surface of the target except the electron striking surface thereof is coated with black chromium plating, improves its heat radiation efficiency about three times as large as that of the conventional one, the fact of which is proved in one experiment. Therefore, the heat produced on the target is effectively dissipated, permitting an easy cooling. For this, the X-ray tube may be continuously operable for long time, more particularlyl the rotating anode X-ray tube may be continuously operable at high speed for long time.

The black chromium plating for the rotating anode X-ray tube is applied mainly to the outer surface of the rotor; however, it may be applied to the surface of the rotary shaft and both the surfaces of the target except the electron striking surface thereof. In the stationary anode X-ray tube, the anode may be cooled by other suitable means other than the heat radiation, but, if the black chromium plating is applied onto the surface of the target supporting rod in which the target is buried, the heat radiation further assists the heat dissipation from the anode, thereby improving the efficiency of the cooling.

Various other modifications of the disclosed embodiment will apparent to the person skilled in the art without departing from the spirit and scope of the invention as defined by the appended claims.

What we claim is:

1. An X-ray tube comprising an anode including a target giving off X-rays when electrons emitted from the filament of a cathode strike the target and supporting means for supporting the target and being subject to transfer of the heat produced on the target due to the strike of electrons thereon, wherein black chromium plating is applied to the anode except the electron striking surface of the target.

2. An X-ray tube according to claim 1, wherein the surface roughness of the anode to be plated by the black chromium ranges from 0.5 to 20 μm.

3. An X-ray tube according to claim 2, wherein the surface roughness of the anode to be plated by black chromium ranges from 5 to 20 μm.

4. An X-ray tube according to claim 1, wherein the thickness of the black chromium plating ranges from 0.5 to 0.2 μm.

5. An X-ray tube according to claim 4, wherein the thickness of the blace chromium plating ranges from 0.05 to 0.1 μm.

6. An X-ray tube according to claim 1, wherein the supporting means has a rotary shaft whose one end is fixed to the target and a rotor fixed to the rotary shaft, the heat from the target being conducted to the rotor through the rotary shaft, and at least the outer surface of the rotor is plated with black chromium.

7. An X-ray tube according to claim 2, wherein the thickness of the black chromium plating ranges from 0.05 to 0.2 μm.

8. An X-ray tube according to claim 7, wherein the supporting means includes a rotary shaft whose one end is fixed to the target and a rotor fixed to the rotary shaft, the heat from the target being conducted to the rotor through the rotary shaft, and at least the outer surface of the rotor is plated with black chromium.

* * * * *